United States Patent [19]

Dubois et al.

[11] 3,955,705

[45] May 11, 1976

[54] PLASTIC DRUM

[75] Inventors: Robert A Dubois, Marion, Ohio; Elmer J. Desher, No. Babylon, N.Y.

[73] Assignee: Greif Bros. Corporation, Delaware, Ohio

[22] Filed: July 15, 1974

[21] Appl. No.: 488,449

Related U.S. Application Data

[63] Continuation-in-part of Ser. No. 324,557, Jan. 17, 1973, abandoned.

[52] U.S. Cl. ..... 220/67; 220/71; 220/73; 220/75; 206/509; 229/5.6

[51] Int. Cl.[2] ..... B65D 7/42; B65D 21/02

[58] Field of Search ..... 220/67, 66, 71, 72, 220/73, 75; 206/501, 503, 509, 508; 229/5.6, 5.7

[56] References Cited

UNITED STATES PATENTS

| | | | |
|---|---|---|---|
| 2,120,487 | 6/1938 | Conner | 220/66 |
| 2,334,041 | 11/1943 | Scott | 229/5.6 |
| 2,810,492 | 10/1957 | Bergen et al. | 220/67 |
| 3,072,517 | 1/1963 | Gaylord | 220/67 |
| 3,140,796 | 7/1964 | Broida | 220/72 |
| 3,279,640 | 10/1966 | Dodson | 220/67 |
| 3,288,342 | 11/1966 | Tinker | 220/67 |
| 3,349,952 | 10/1967 | Bijvoet | 220/67 |
| 3,543,963 | 12/1970 | Heisler et al. | 220/67 |
| 3,815,774 | 6/1974 | Olsson | 220/72 |

*Primary Examiner*—William Price
*Assistant Examiner*—Joseph M. Moy
*Attorney, Agent, or Firm*—Kane, Dalsimer, Kane, Sullivan and Kurucz

[57] ABSTRACT

An improved drum is provided comprising an elongated tubular body member formed of a plastic material. The drum further includes plastic top and bottom closures secured to opposite ends of the body member and including portions which extend respectively over the top and bottom ends of the body member. Metal chimes encircle the interfaces of both the top and bottom closures with the body member and secure the closures to the body member. Each chime is spirally wound inwardly about the interface through at least 360° of arc. An accordion-like member extends between the body member and bottom to allow for greater flexibility. The top and bottom closures are designed to enable stacking of the drum on another drum of similar construction.

8 Claims, 7 Drawing Figures

FIG. 1
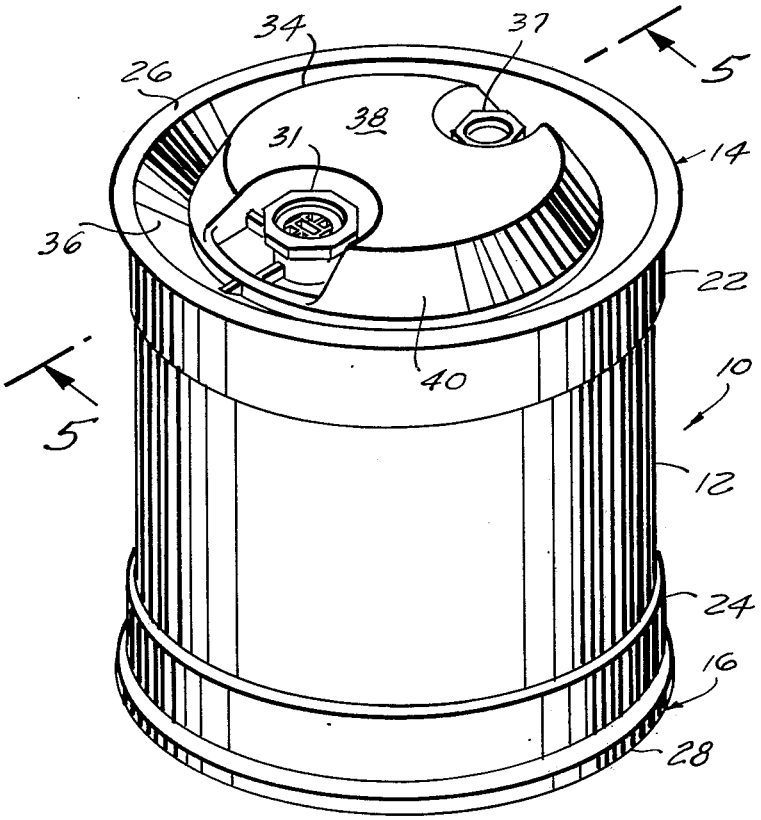
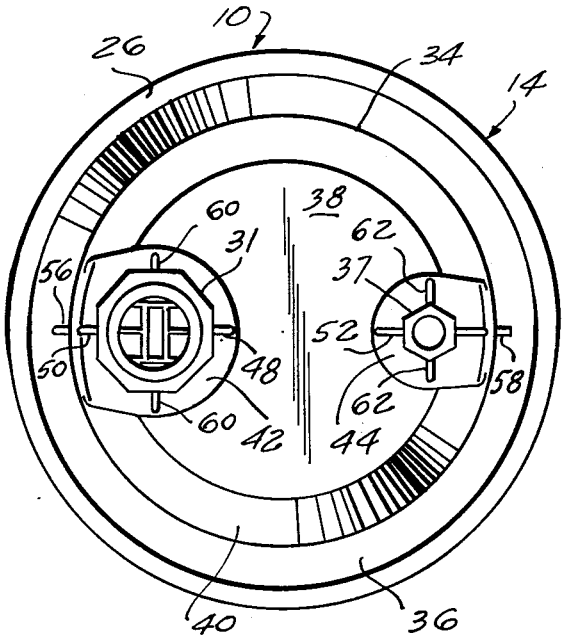
FIG. 2
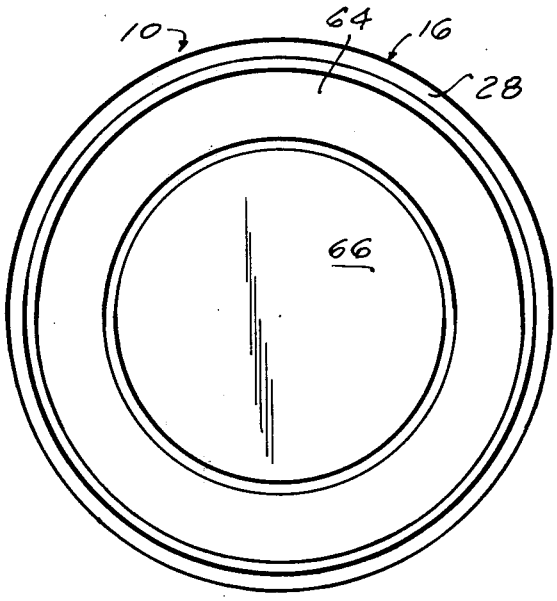
FIG. 3

FIG. 5
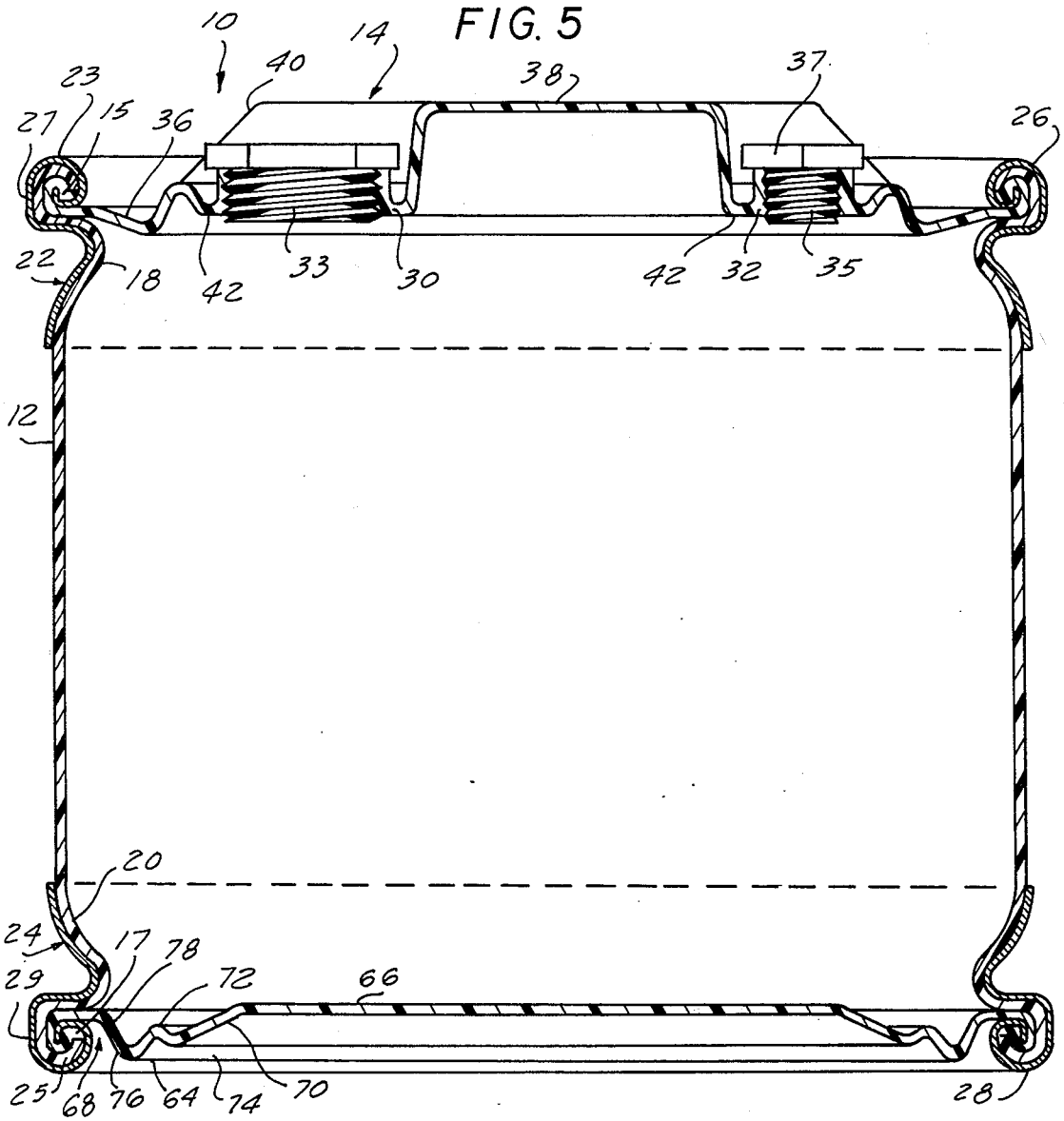
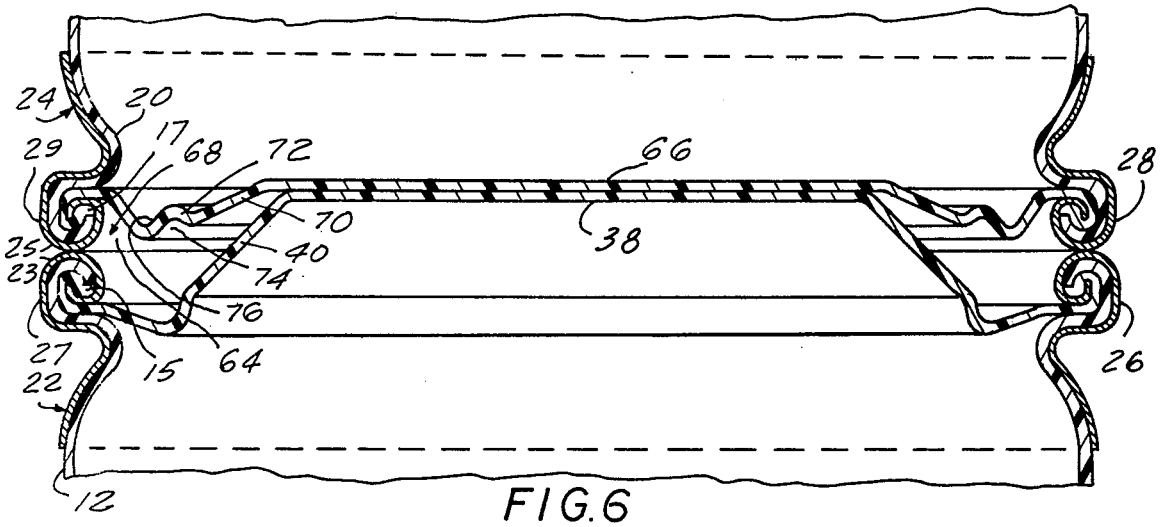
FIG. 6

PLASTIC DRUM

The present application is a continuation-in-part of application Ser. No. 324,557 filed Jan. 17, 1973 now abandoned.

BACKGROUND OF THE INVENTION

The present application relates to an all plastic drum for use in the shipping and storing of liquid or semiliquid bulk materials.

Liquids and semiliquids are commonly transported in drumlike containers. In recent years, the trend has been to form such containers of an outer shell of laminated layers of fibrous material and to provide the shell with an inner plastic liner. The liner is generally impervious to the drum contents and, as such, prevents leakage and/or contamination. The fiber shell while providing needed strength and rigidity to the drum also adds considerable weight which is undesirable. Also, in most cases, the fiber shell is subject to deterioration if exposed to heat, cold, water or ice for extended periods.

In view of the above, it is the principal object of the present invention to provide an improved drum which is comparably strong to prior art drums and which is appreciably lighter and more durable.

SUMMARY OF THE INVENTION

The above and other beneficial objects and advantages are attained in accordance with the present invention by providing a drum comprising a tubular plastic body member with top and bottom closures also formed of plastic. The top and bottom closures are secured to opposite ends of the body member and include portions which extend respectively over the top and bottom ends of the body member. A metal chime is provided at each end of the drum overlying the closure and adjacent tube portions. The chimes encircle the interfaces of both the top and bottom closures with the body member and secure the closures to the body member. The chime is spirally wound about the interfaces through at least 360° of arc.

The bottom closure is connected to the body member by an accordion-like element which provides increased flexibility to the drum bottom thereby enabling it to withstand greater loads. A neck defining an access opening to the drum interior is provided on the top closure. The drum top and bottom closures are so contoured as to facilitate stacking of the drum on another similar drum.

BRIEF DESCRIPTION OF THE DRAWINGS

In the accompanying drawings:

FIG. 1 is a perspective view of an improved drum in accordance with the present invention;

FIG. 2 is a top plan view of the drum illustrating the drum top closure;

FIG. 3 is a bottom plan view of the drum illustrating the drum bottom closure;

FIG. 5 is a side elevational sectional view taken along reference lines 5—5 of FIG. 1;

FIG. 6 is a fragmentary side elevational sectional view illustrating the manner in which one drum in accordance with the present invention may be stacked on top of another similar drum and also illustrating the rolled top and bottom chimes; and, FIG. 7 is an enlarged fragmentary sectional view of the top closure, chimes and body member prior to rolling of the chimes.

DETAILED DESCRIPTION OF THE PREFERRED EMBODIMENT

Figures 4, 7:
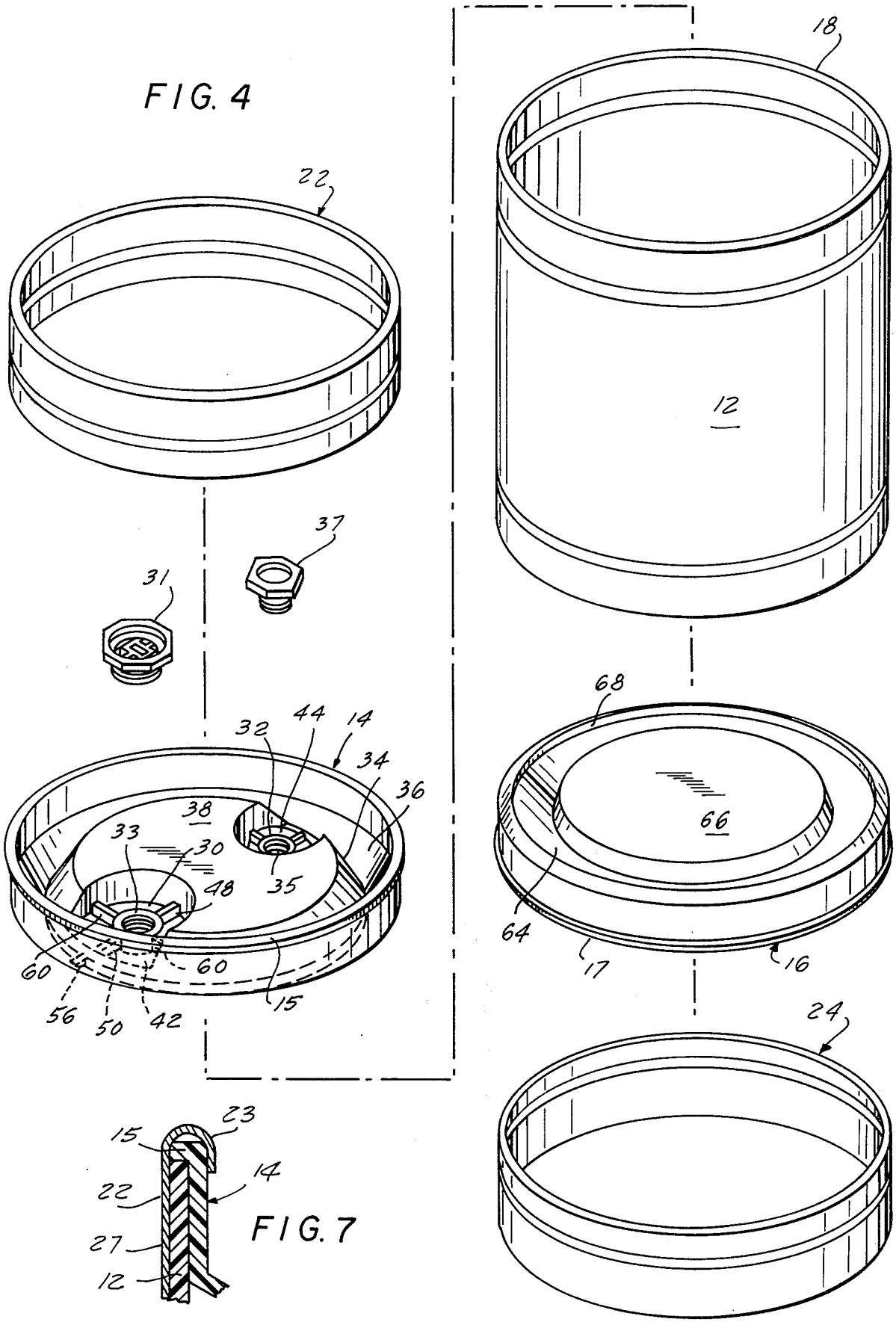
FIG. 4 is an exploded view of the various components of the present drum.

The present invention is illustrated in the accompanying drawings wherein similar components bear the same reference numeral throughout the several views. Accordingly, the present drum 10 comprises a tubular body member 12 closed at its top end by top closure 14 and at its bottom end by bottom closure 16. Tubular member 12 and the closures 14 and 16 are each formed of a fusible plastic material such as polyethylene, polypropylene or the like.

The top closure 14 and bottom closure 16 are each formed with a peripheral ledge that extends radially outwardly to overlie the ends of the body member. Accordingly, ledge 15 of closure 14 overlies the top end of the body member and ledge 17 of closure 16 underlies the bottom end of the body member. Steel chimes 22 and 24 are provided for the top and bottom of the drum respectively to secure the closures to the body member. Referring to FIG. 4, it can be seen that the chimes 22 and 24 are each formed with an inwardly and downwardly directed rolled edge (23 and 25 respectively). Rolled edge 23 cooperates with the main body portion 27 of chime 22 to form a clamp securing the top closure and body member together as shown in FIG. 7. Similarly, the rolled edge 25 of chime 24 together with the main portion 29 of chime 24 forms a clamp for securing the bottom closure and body member together.

Referring to FIG. 5, it may be seen that top chime 22 is rolled inwardly so that it extends over the top of body member 12 and includes a lip portion 26 rolled inwardly and over the peripheral edge of top closure 14 so that the clamp becomes the innermost part of the rolled portion of the chime. Similarly, bottom chime 24 is rolled inwardly so that it extends under the bottom of body member 12 and includes a lip 28 rolled inwardly and under the peripheral edge of bottom closure 16. It should be noted that the chimes only engage the exterior of the body member and their associated closures and are not exposed to the drum interior. It should also be noted that both chimes are spirally wound inwardly through more than a full 360° of arc. This is an important feature of the present invention since if any part of the rolled portion of the chime is struck a blow, the force of the blow serves to tighten the seal between the body member and closure by driving the top or bottom edge of the body member into the associated pocket formed by the ledge in the associated closure. In this connection, it should also be noted that since the bottom chime rolled portion extends below the bottom closure, it will receive most impacts during loading.

The drum top closure is provided with two upwardly extending necks 30 and 32. Neck 30 defines an access opening to the drum interior and neck 32 defines a vent opening. The necks 30 and 32 are provided with suitable fittings 33 and 35 to receive associated covers 31 and 37.

Referring to FIGS. 2 and 4, it is noted that the top closure 14 is molded to include an integral, centrally disposed, raised portion or protrusion 34 which extends upwardly from a downwardly tapering base portion 36. A downwardly tapering sidewall 40 connects the protrusion top 38 and base 36. As may be seen, protrusion 34 is generally circular in plan and the top 38 is flat. Base 36 includes two flat sections 42 and 44 which extend into and interrupt the circular configuration of protrusion 34. As may be seen in FIG. 5, necks 30 and 32 extend from base sections 42 and 44 respectively to a height considerably below that of the top 38 of protrusion 34 so that covers 31 and 37 will not extend beyond top 38 when they are positioned over necks 30 and 32 respectively.

In order to reinforce necks 30 and 32, a plurality of reinforcing ribs are provided on the top surface of the drum top closure. Accordingly, rib 48 extends from neck 30 radially inwardly (toward the center of the closure) over parts of section 42 and rib 50 extends outwardly along the same radius. Similarly, rib 52 extends from neck 32 radially inwardly over parts of section 44 along portions of a radius of the top closure and rib 54 extends outwardly along the same radius. Additional reinforcing for neck 30 and section 42 is provided by ribs 60 which extend from the neck perpendicular to the radius of ribs 48 and 50. Similarly, ribs 62 extend from neck 32 perpendicular to the radius of ribs 52 and 54. The various reinforcing ribs discussed above are integrally molded with the various other portions of closure 14 (with the exception of the fittings 33 and 35 for necks 30 and 32) and serve to provide the plastic closure with strength and rigidity comparable to conventional closures.

Bottom closure 16 is secured to the body member in a manner similar to that in which the top closure 14 is secured, namely, by virtue of the rolled edge of the bottom chime forming a clamp to hold the body portion and bottom closure together. Referring first to FIG. 5, it is noted that bottom closure 16 is molded to include a generally flat base portion 64 and surfaces 66 deformed from the flat base to define an upwardly extending recess. The recess 66 is complementary to protrusion 34 so that, as shown in FIG. 6, one such drum may conveniently nest on top of another similar drum. The recess 66 is connected to the body member by an accordion-like member 68 formed integrally with the closure. Member 68 is in the form of a ring surrounding the body member and consists of a series of alternate downwardly and upwardly directed sections. In the illustrated embodiment, section 70 extends downwardly from the edge of recess 66, followed by section 72 which extends upwardly, section 74 which again extends downwardly, section 76 which extends upwardly, and section 78 which extends downwardly and then is joined to the body member. It should be apparent that under a sufficient load, the accordion-like member 68 will yield thus enabling the container to withstand the load. This is especially important where, for example, the contents of the container are thrown in causing a temporary shock load condition.

It will thus be seen that the aforementioned objects and advantages are most effectively attained in accordance with the above. It will also be realized that although a specific embodiment of our invention has been described and illustrated, various changes therein will become evident to one skilled in the art. Therefore, our invention is to be determined by the scope of the appended claims.

Having thus described the invention what is claimed is:

1. An essentially all plastic drum comprising:
an elongated tubular plastic body member;

a plastic bottom closure secured to one end portion of said body member;
a plastic top closure secured to the other end portion of said body member;
at least one opening in one of said closures;
said top closure including a radially outwardly extending peripheral ledge overlying the top edge of said body member;
a top chime being rolled inwardly about the top end portion of said body member and said top closure, said top chime when unrolled including a main body portion and a radially inwardly and downwardly extending top portion overlying and contacting the outer surfaces of said top closure ledge and said top end portion of said body member and clamping said top closure ledge and said top end portion of said body member together;
said top chime being spirally wound inwardly about said top closure and said top end portion of said body member through at least 360° of arc and being completely out of contact with the interior of said drum; and,
a bottom chime substantially identical in construction to said top chime securing said bottom closure to said body member.

2. The drum in accordance with claim 1 wherein said bottom closure includes a base portion and surfaces extending upwardly from said base defining a recess and said top closure includes a base portion and surfaces extending from said base defining a protrusion, said protrusion being complementary to said recess whereby to enable stacking of said drum onto another similar drum.

3. The drum in accordance with claim 2 wherein said top closure protrusion is generally circular in plan interrupted by a section of said top closure base and further comprising a neck extending upwardly from said base section defining an access opening into the drum interior, said neck extending to a height less than the height of the top of said protrusion.

4. The drum in accordance with claim 3 further comprising a first reinforcing rib overlying portions of said base section extending radially inwardly from said neck and a second reinforcing rib overlying portions of said base section extending outwardly from said neck along the same radius as said first rib.

5. The drum in accordance with claim 4 further comprising a second section of said top closure base interrupting the circular plan of said protrusion, a second neck extending from said second section defining an opening into the drum interior; a first reinforcing rib overlying portions of said second section extending radially inwardly from said second neck and a second reinforcing rib extending radially outwardly from said second neck along the same radius.

6. The drum in accordance with claim 1 further comprising flexible means interconnecting said bottom closure and said body member.

7. The drum in accordance with claim 6 wherein said flexible means comprises an accordion-type member formed of a plurality of interconnected alternately upwardly and downwardly directed sections.

8. The drum in accordance with claim 6 wherein said flexible means is formed integrally with the bottom closure.

* * * * *